US011121452B2

(12) United States Patent
Hsu et al.

(10) Patent No.: US 11,121,452 B2
(45) Date of Patent: Sep. 14, 2021

(54) ANTENNA AND WIRELESS COMMUNICATION DEVICE USING THE SAME

(71) Applicant: Chiun Mai Communication Systems, Inc., New Taipei (TW)

(72) Inventors: Cho-Kang Hsu, New Taipei (TW); Min-Hui Ho, New Taipei (TW); Yi-Ting Chen, New Taipei (TW); Yen-Jung Tseng, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 29 days.

(21) Appl. No.: 16/567,291

(22) Filed: Sep. 11, 2019

(65) Prior Publication Data

US 2020/0106159 A1 Apr. 2, 2020

(30) Foreign Application Priority Data

Sep. 28, 2018 (CN) ..... 201811142608.2

(51) Int. Cl.

| | |
|---|---|
| ***H01Q 1/24*** | (2006.01) |
| ***H01Q 1/50*** | (2006.01) |
| ***H01Q 1/48*** | (2006.01) |
| ***H01Q 5/30*** | (2015.01) |

(52) U.S. Cl.
CPC ..... *H01Q 1/243* (2013.01); *H01Q 1/48* (2013.01); *H01Q 1/50* (2013.01); *H01Q 5/30* (2015.01)

(58) Field of Classification Search
CPC ..... H01Q 1/243; H01Q 1/50; H01Q 1/48; H01Q 5/30; H01Q 5/328; H01Q 1/36
See application file for complete search history.

(56) References Cited

U.S. PATENT DOCUMENTS

2019/0027833 A1* 1/2019 Ayala Vazquez .. H01Q 21/0006
2019/0393586 A1* 12/2019 Ayala Vazquez ..... H01Q 9/42
2020/0321688 A1* 10/2020 Khripkov ..... H01Q 1/243

FOREIGN PATENT DOCUMENTS

CN 103390793 A 11/2013

* cited by examiner

*Primary Examiner* — Daniel D Chang
(74) *Attorney, Agent, or Firm* — ScienBiziP, P.C.

(57) ABSTRACT

An antenna structure of reduced size but able to cover first, second, and third LTE-A bands together with WI-FI and BLUETOOTH frequencies includes a metal frame defining at least two gaps. The gaps extend and pass completely through the metal frame, and divide the metal frame into radiating portions. At least one feeding portion is electrically coupled to each radiating portion. Each radiating portion can simultaneously activate first, second, and third operating modes for the radiation of signals in first, second, and third frequency bands.

20 Claims, 18 Drawing Sheets

ANTENNA AND WIRELESS COMMUNICATION DEVICE USING THE SAME

FIELD

The subject matter herein generally relates to antennas.

BACKGROUND

Electronic devices such as mobile phones and personal digital assistants become smaller, thinner, and faster, with ever more functions. However, a space for receiving an antenna becomes smaller and smaller and a requirement for a bandwidth of the antenna is increasing. Creating an antenna with a wider bandwidth in a limited space is problematic.

Therefore, there is room for improvement within the art.

BRIEF DESCRIPTION OF THE DRAWINGS

Implementations of the present disclosure will now be described, by way of embodiment, with reference to the attached figures.

DETAILED DESCRIPTION

Figure 1:
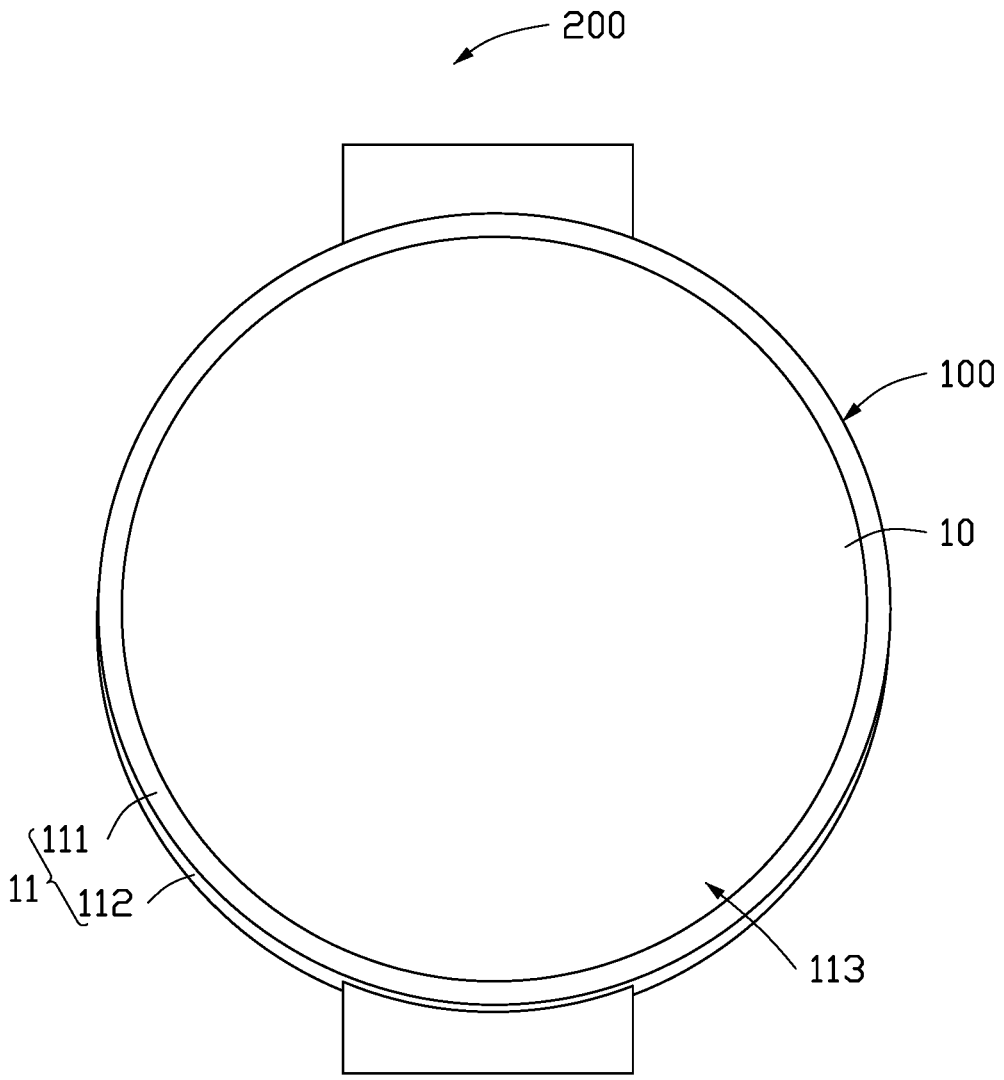
FIG. 1 is an isometric view of an antenna structure applicable in a wireless communication device according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using the same.

FIG. 1 illustrates an antenna structure 100 in a wireless communication device 200 according to a first embodiment. The antenna structure 100 can receive and transmit wireless signals. The wireless communication device 200 can be, for example, a smart wearable device such as a watch, a headset, or the like. In other embodiment, the wireless communication device 200 can also be a communication device such as a mobile phone, a CPE (Customer Premise Equipment), or the like. In this embodiment, the wireless communication device 200 is a smart watch as an example.

The wireless communication device 200 includes a main board 10. The main board 10 supports the antenna structure 100. The main board 10 can be a printed circuit board (PCB). The main board 10 can be made of a dielectric material such as epoxy glass fiber (FR4). In an embodiment, the main board 10 is substantially circular in shape. In other embodiment, a shape of the main board 10 is not limited to being circular, and can be adjusted according to the requirements. For example, the main board 10 can be square, rectangular, diamond shape, hexagonal, or the like.

Figure 2:
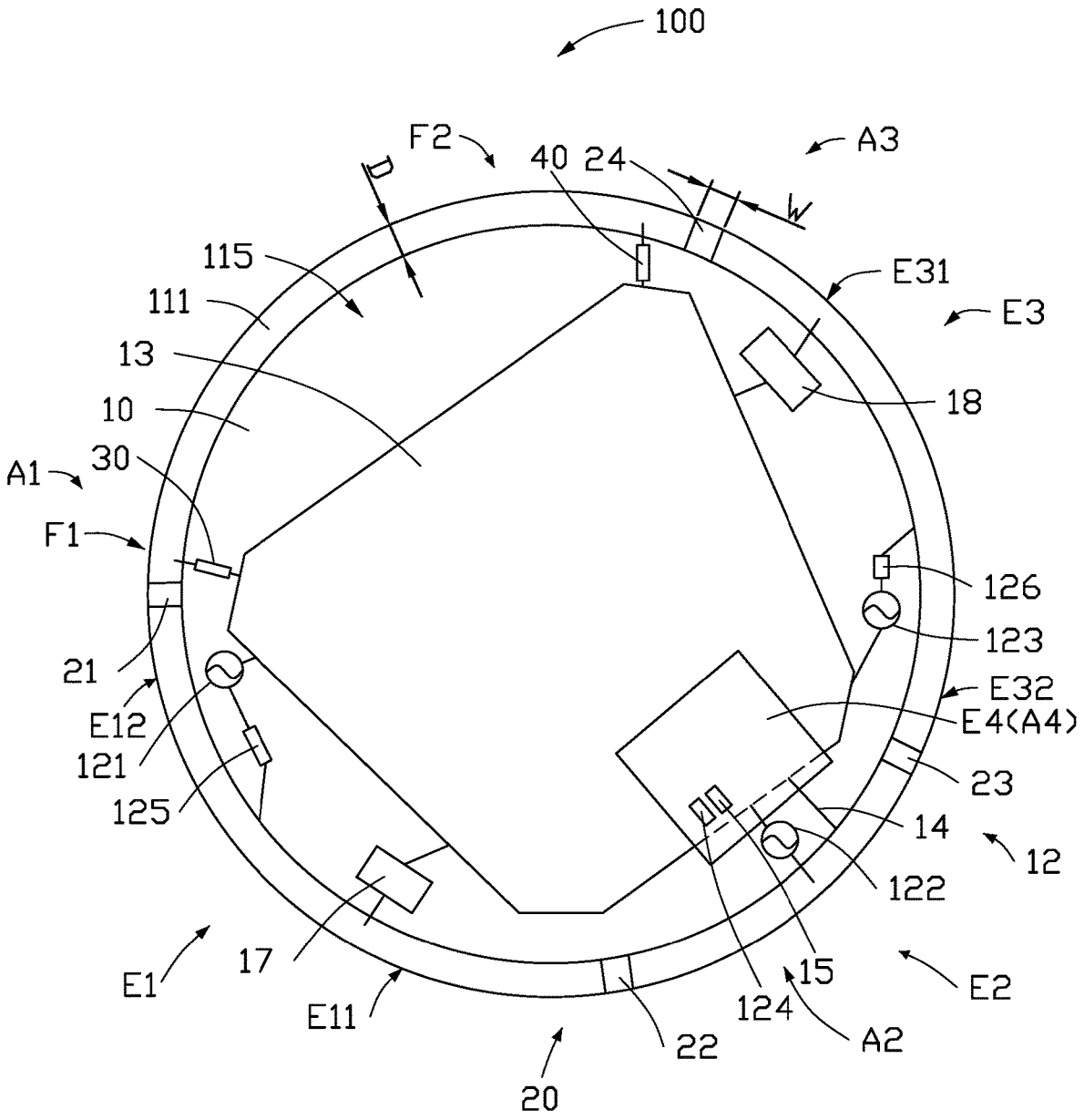
FIG. 2 is an isometric view of the antenna structure of FIG. 1.

Referring to FIG. 2, the main board 10 includes at least one feeding portion 12, a grounding plane 13, a first grounding portion 14, and a second grounding portion 15. The at least one feed portion 12 feeds current to the antenna structure 100. The grounding plane 13 can include a metal material or other conductive materials, configured for providing grounding for the antenna structure 100. The grounding plane 13 can be positioned on the main board 10.

The antenna structure 100 at least includes a housing 11. The housing 11 at least includes a metal frame 111. In this embodiment, the metal frame 111 is substantially annular, specifically it is circular. In other embodiment, a shape of the metal frame 111 is not limited to being circular, and can be adjusted according to the requirements. For example, the metal frame 111 can be square, rectangular, diamond sharp, hexagonal, or the like as long as the metal frame 111 is shape of a closed ring.

In this embodiment, the metal frame 111 can be made of a metal material or other conductive materials. The metal frame 111 is positioned on a periphery of the grounding plane 13. Thus, the metal frame 11 surrounds the grounding plane 13. The metal frame 111 is spaced apart from the grounding plane 13 to form a keep-out-zone 115 therebetween. The purpose of the keep-out-zone 115 is to maintain an empty space and not permit the presence of other electronic elements (such as a camera, a vibrator, a speaker, etc.)

In this embodiment, distances between the metal frame 111 and the system ground plane 13 can be adjusted according to requirements. For example, the distances between different points of the metal frame 111 and the grounding plane 13 can be equidistant or unequal. The metal frame 111 can be electrically coupled to a signal feeding point (not shown) on the grounding plane 13 by means of a spring piece, a solder connection, a spring pin, or the like.

In this embodiment, the housing 11 can further include a back cover 112. The back cover 112 covers an edge of the metal frame 111. The back cover 112 and the metal frame 111 cooperatively define a receiving space 113. The receiving space 113 is configured for receiving the main board 10 of the wireless communication device 200. Electronic components or circuit modules such as a processing unit of the wireless communication device 200 can be positioned on the main board 10.

Figure 3:
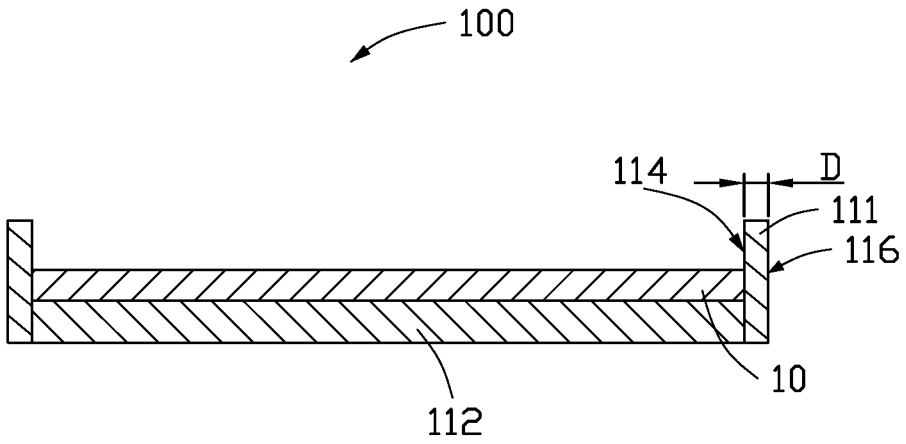
FIG. 3 is cross-section view of the antenna structure of FIG. 1.

Referring to FIG. 3, the metal frame 111 includes a first surface 114 and a second surface 116 opposite to the first surface 114. The first surface 114 is positioned adjacent to the main board 10. A thickness of the metal frame 111 is designated D. Thus, a distance between the first surface 114 and the second surface 116 is also D.

In this embodiment, the housing 11 further defines at least two gaps. In this embodiment, the housing 11 defines four gaps, which are first to fourth gaps 21-24. The first gap 21, the second gap 22, the third gap 23, and the fourth gap 24 are all defined in the metal frame 111. The first gap 21, the second gap 22, the third gap 23, and the fourth gap 24 are all spaced apart from each other. Each of the first gap 21, the second gap 22, the third gap 23, and the fourth gap 24 extends and passes through the metal frame 111. A width W of each of the first gap 21, the second gap 22, the third gap 23, and the fourth gap 24 is the same. In this embodiment, $W<2*D$. Thus, the widths W of the first gap 21, the second gap 22, the third gap 23, or the fourth gap 24 is less than or equal to twice the thickness D of the metal frame 111. In other embodiment, the widths W of the first gap 21, the second gap 22, the third gap 23, and the fourth gap 24 can be same or completely different.

The at least two gaps divide at least two radiating portions from the housing 11. In this embodiment, the first gap 21, the second gap 22, the third gap 23, and the fourth gap 24 cooperatively divide the housing 11 into three radiating portions, which include, a first radiating portion E1, a second radiating portion E2, and a third radiating portion E3. In this embodiment, a portion of the metal frame 111 between the first gap 21 and the second gap 22 forms the first radiating portion E1. A portion of the metal frame 111 between the second gap 22 and the third gap 23 forms the second radiating portion E2. A portion of the metal frame 111 between the third gap 23 and the fourth gap 24 forms the third radiating portion E3.

The antenna structure 100 further includes a fourth radiating portion E4. The fourth radiating portion E4 is positioned on the main board 10. Thus, the fourth radiating portion E4 is a built-in radiating element positioned on the metal frame 111. In this embodiment, the fourth radiating portion E4 can be made of a material such as a metal, a copper foil, or formed by laser direct structuring (LDS).

In this embodiment, a portion of the metal frame 111 between the first gap 21 and the fourth gap 24 adjacent to the first gap 21 forms a first branch F1. A portion of the metal frame 111 between the first gap 21 and the fourth gap 24 adjacent to the fourth gap 24 forms a second branch F2.

In this embodiment, the first gap 21, the second gap 22, the third gap 23, and the fourth gap 24 are filled with an insulating material, such as plastic, rubber, glass, wood, ceramics, etc., not being limited to these.

Referring to FIG. 2, in the embodiment, the at least one feeding portion 12 includes a first feeding portion 121, a second feeding portion 122, a third feeding portion 123, and a fourth feeding portion 124. The first feeding portion 121, the second feeding portion 122, and the third feeding portion 123 are disposed in the keep-out-zone area 115 between the grounding plane 13 and the metal frame 111. The fourth feeding portion 124 is disposed above the grounding plane 13.

One end of the first feeding portion 121 is electrically coupled to a side of the first radiating portion E1 adjacent to the first gap 21 through a first matching circuit 125. The other end of the first feeding portion 121 is electrically coupled to the grounding plane 13 to be grounded. The first feeding portion 1221 feeds current to the first radiating portion E1. The first matching circuit 125 provides an impedance matching between the first feeding portion 121 and the first radiating portion E1.

One end of the second feeding portion 122 is electrically coupled to the second radiating portion E2. The other end of the second feeding portion 122 is electrically coupled to the grounding plane 13 to be grounded. The second feeding portion 122 feeds current to the second radiating portion E2.

One end of the third feeding portion 123 is electrically coupled to a side of the third radiating portion E3 adjacent to the third gap 23 through a second matching circuit 126. The other end of the third feeding portion 123 is electrically coupled to the grounding plane 13 to be grounded. The third feeding portion 123 feeds current to the third radiating portion E3. The second matching circuit 126 provides impedance matching between the third feeding portion 123 and the third radiating portion E3.

One end of the fourth feeding portion 124 can be electrically coupled to a signal feeding point (not shown) on the grounding plane 13 through a spring piece, a microstrip line, a strip line, a coaxial cable, or the like. The other end of the fourth feeding portion 124 is electrically coupled to the fourth radiating portion E4. The fourth feeding portion 124 feeds current to the fourth radiating portion E4. The fourth radiating portion E4 is positioned in the receiving space 113 and between the second gap 22 and the third gap 23. The fourth radiating portion E4 is substantially a sheet of material, which can be a Flexible Printed Circuit (FPC) or formed by Laser Direct Structuring (LDS).

In this embodiment, the first grounding portion 14 is positioned inside the housing 11 and between the second gap 22 and the third gap 23. One end of the first grounding portion 14 is grounded through the grounding plane 13. The other end of the first grounding portion 14 is electrically coupled to one end of the second radiating portion E2 adjacent to the third gap 23. The first grounding portion 14 provides grounding for the second radiating portion E2. One end of the second grounding portion 15 is grounded through the grounding plane 13. The other end of the second grounding portion 15 is electrically coupled to the fourth radiating portion E4. The second grounding portion 15 provides grounding for the fourth radiating portion E4.

In this embodiment, the first feeding portion 121 divides the first radiating portion E1 into two portions, which include a first radiating section E11 and a second radiating section E12. A portion of the metal frame 111 between the first feeding portion 121 and the second gap 22 forms the first radiating section E11. A portion of the metal frame 111 between the first feeding portion 121 and the first gap 21 forms the second radiating section E12. In this embodiment, a position of the first feeding portion 121 does not correspond to a middle portion of the first radiating portion E1. Thus, a length of the first radiating portion E11 is longer than that of the second radiating portion E12.

In this embodiment, the third feeding portion 123 divides the third radiating portion E3 into two portions, which include a third radiating section E31 and a fourth radiating section E32. A portion of the metal frame 111 between the third feeding portion 123 and the fourth gap 24 forms the third radiating section E31. A portion of the metal frame 111 between the third feeding portion 123 and the third gap 23 forms the fourth radiating section E32. In this embodiment, a position of the third feeding portion 123 does not correspond to a middle portion of the third radiating portion E3. Thus, a length of the third radiating portion E31 is longer than that of the fourth radiating portion E32.

Figure 4:
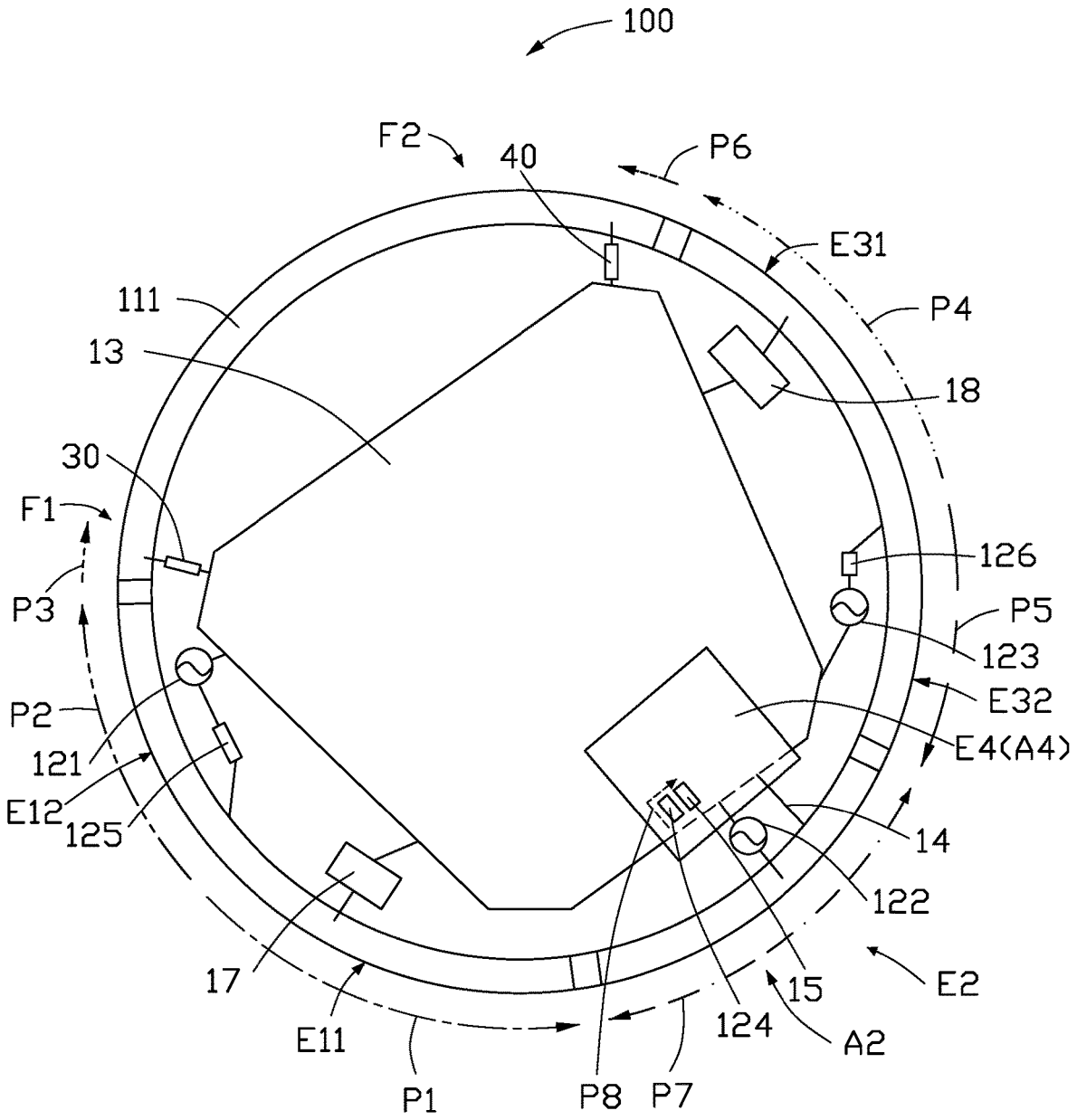
FIG. 4 is a current path distribution graph of the antenna structure of FIG. 2.

Referring to FIG. 4, when the first feeding portion 121 supplies current, the current flows through the first matching circuit 125 and then the first radiating section E11, and flows to one end of the first radiant section E11 adjacent to the second gap 22, thereby activating a first operating mode to generate radiation signals in a first frequency band (labeled as path P1). Meanwhile, when the first feeding portion 121 supplies current, the current also flows through the first matching circuit 125 and the second radiation section E12, and then flows to one end of the second radiation section E12 adjacent to the first gap 21. Thereby a second operating mode is activated, to generate radiation signals in a second frequency band (labeled as path P2). In addition, when the first feeding portion 121 supplies current, the current also flows through the first matching circuit 125 and the second radiating section E12, and is coupled to the first branch F1 thereby activating a third operating mode to generate radiation signals in a third frequency band (labeled as path P3).

When the third feeding portion 123 supplies current, the current flows through the second matching circuit 126 and the third radiation section E31, and flows to one end of the third radiation section E31 adjacent to the fourth gap 24, thereby activating the first operating mode to generate radiation signal of the first frequency band (labeled as path P4). Meanwhile, when the third feeding portion 123 supplies current, the current also flows through the second matching circuit 126 and the fourth radiation section E32, and flows to one end of the fourth radiation section E32 adjacent to the third gap 23. Thereby the second operating mode is activated, to generate radiation signals in the second frequency band (labeled as path P5). In addition, when the third feeding portion 123 supplies current, the current also flows through the second matching circuit 126 and the third radiation section E31, and is coupled to the second branch F2 thereby activating the third operating mode to generate radiation signals in the third frequency band (labeled as path P6).

When the second feeding portion 122 supplies current, the current flows through the second radiation section E2, thereby activating a fourth operating mode to generate radiation signals in a fourth frequency band (labeled as path P7). When the fourth feeding portion 124 supplies current, the current flows through the fourth radiation section E4, thereby activating a fifth operating mode to generate radiation signals in a fifth frequency band (this being labeled path P8).

In this embodiment, the first operating mode is an LTE-A low frequency operating mode. The second operating mode is an LTE-A middle frequency operating mode. The third operating mode is an LTE-A high frequency operating mode. The fourth operating mode is a global positioning system (GPS) mode. The fifth operating mode includes a WIFI 2.4 GHz mode and a WIFI 5 GHz mode.

In this embodiment, a frequency of the first radiation frequency band is lower than a frequency of the fourth radiation frequency band. The frequency of the fourth radiation frequency band is lower than a frequency of the second radiation frequency band. The frequency of the second radiation frequency band is lower than a frequency of the third radiation frequency band and a frequency of the fifth frequency band. The frequency of the fifth frequency band is a portion of the frequency of third frequency band. The first radiation frequency band is about 700-960 MHz. The second radiation frequency is about 1710-2170 MHz. The third radiation frequency band is about 2300-2690 MHz. The fourth radiation frequency band is about 1550-1612 MHz. The fifth radiation frequency band is about 2400-2480 MHz.

Therefore, in this embodiment, the first feeding portion 121, the first radiating section E11, the second radiating section E12, and the first branch F1 cooperatively form a first antenna A1. The second feeding portion 122 and the second radiating portion E2 cooperatively form a second antenna A2. The third feeding portion 123, the third radiating portion E31, the fourth radiating portion E32, and the second branch F2 cooperatively form a third antenna A3. The fourth feeding portion 124 and the fourth radiating portion E4 cooperatively form a fourth antenna A4. The first antenna is a main antenna. The second antenna A2 is a GPS antenna. The third antenna is a diversity antenna, which is also a secondary antenna. In this embodiment, the fourth antenna A4 is a WIFI 2.4G and BLUETOOTH antenna. The WIFI 2.4G and BLUETOOTH antenna can cooperatively form a monopole antenna. In other embodiment, the fourth antenna A4 is not limited to a monopole antenna, and can also be a Planar Inverted F-shaped Antenna (PIFA). The WIFI 2.4G and BLUETOOTH antenna can also function as separate antennas.

In other embodiments, positions of the first antenna A1, the second antenna A2, the third antenna A3, and the fourth antenna A4 can be adjusted according to the requirements, as long as the locations meet the requirement that the first antenna A1 and the third antenna A3 be separated from each other to increase an isolation between the first antenna A1 and the third antenna A3.

Referring to FIG. 2, in other embodiment, the antenna structure 100 further includes a first inductor 30 and a second inductor 40. One end of the first inductor 30 is connected to the first branch F1. The other end of the first inductor 30 is connected to the grounding plane 13. One end of the second inductor 40 is connected to the second branch F2. The other end of the second inductor 40 is connected to the grounding plane 13. By adjusting inductance values of the first inductor 30 and the second inductor 40, the third frequency band (i.e. the frequency of the LTE-A high frequency band) can be effectively adjusted.

Figure 5:
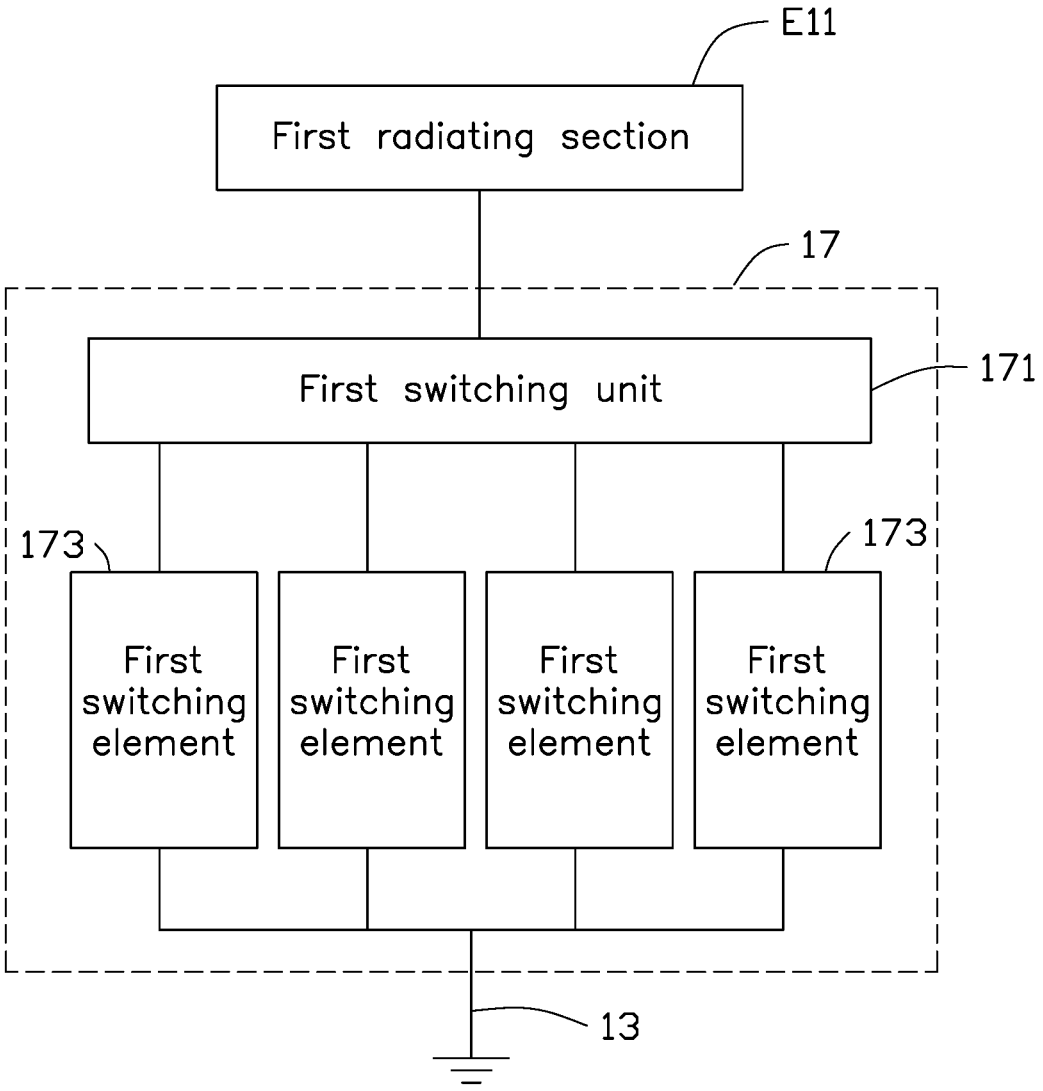
FIG. 5 is a circuit diagram of a first switching circuit of the antenna structure of FIG. 2.

Referring to FIG. 5, in other embodiment, the antenna structure 100 further includes a first switching circuit 17. The first switching circuit 17 is positioned in the receiving space 113. One end of the first switching circuit 17 is connected to the first radiating section E11. The other end of the first switching circuit 17 is connected to the grounding plane 13. The first switching circuit 17 includes a first switching unit 171 and at least one first switching element 173. The first switching unit 171 is electrically coupled to the first radiating section E11. Each first switching element 173 can be one of an inductor, a capacitor, and a combination of the inductor and the capacitor. The first switching elements 173 are connected in parallel with each other. One end of each first switching element 173 is electrically coupled to the first switching unit 171. The other end of each first switching element 173 is connected to the grounding plane 13.

As such, under the control of the first switching unit 171, the first radiating section E1 can be switched to connect with a different first switching element 173. Since each first switching element 173 has a different impedance, the frequency band of the first radiating section E1 (i.e. the frequency of the LTE-A low frequency band) can be effectively adjusted. For example, in an embodiment, the first switching circuit 17 includes four different first switching elements 173. Under control of the first switching unit 173, the first radiating section E1 can be switched to connect with one of four different first switching elements 173. Thus, a low frequency band of the first operating mode of the antenna structure 100 can cover a frequency band of LTE-A Band 17 (704-746 MHz), a frequency band of LTE-A Band 13 (746-787 MHz), a frequency band of LTE-A Band 20 (791-862 MHz), and a frequency band of LTE-A Band 8 (880-960 MHz).

Figure 6:
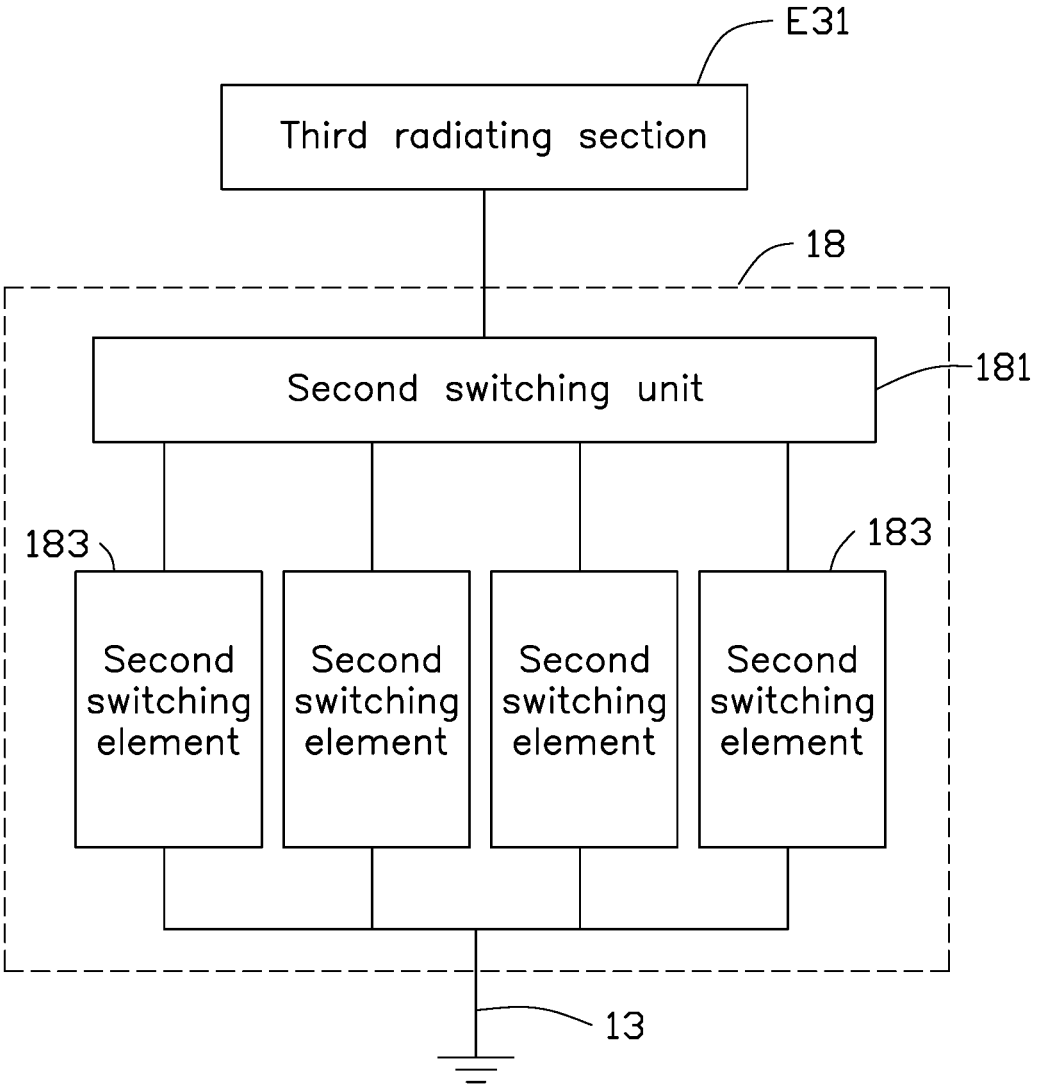
FIG. 6 is a circuit diagram of a second switching circuit of the antenna structure of FIG. 2.

Referring to FIG. 6, in other embodiment, the antenna structure 100 further includes a second switching circuit 18. The second switching circuit 18 is positioned in the receiving space 113. One end of the second switching circuit 18 is connected to the third radiating section E31. The other end of the second switching circuit 18 is connected to the grounding plane 13 to be grounded. The second switching circuit 18 includes a second switching unit 181 and at least one second switching element 183. The second switching unit 181 is electrically coupled to the third radiating section E31. Each second switching element 183 can be one of an inductor, a capacitor, and a combination of the inductor and the capacitor. The second switching elements 183 are connected in parallel with each other. One end of each second switching element 183 is electrically coupled to the second switching unit 181. The other end of second first switching element 183 is connected to the grounding plane 13 to be grounded.

Under the control of the second switching unit 181, the third radiating section E31 can be switched to connect with a different second switching element 183. Since each of the second switching elements 183 has a different impedance, the frequency band of the third radiating portion E31 (i.e. the frequency of the LTE-A low frequency band) can be effectively adjusted. For example, in an embodiment, the second switching circuit 18 includes four different second switching elements 183. Under control of the second switching unit 183, the third radiating portion E31 can be switched to connect with one of the four different second switching elements 183. Then, a low frequency band of the first operating mode of the antenna structure 100 can cover a frequency band of LTE-A Band 17 (704-746 MHz), a frequency band of LTE-A Band 13 (746-787 MHz), a frequency band of LTE-A Band 20 (791-862 MHz), and a frequency band of LTE-A Band 8 (880-960 MHz).

Figure 7:
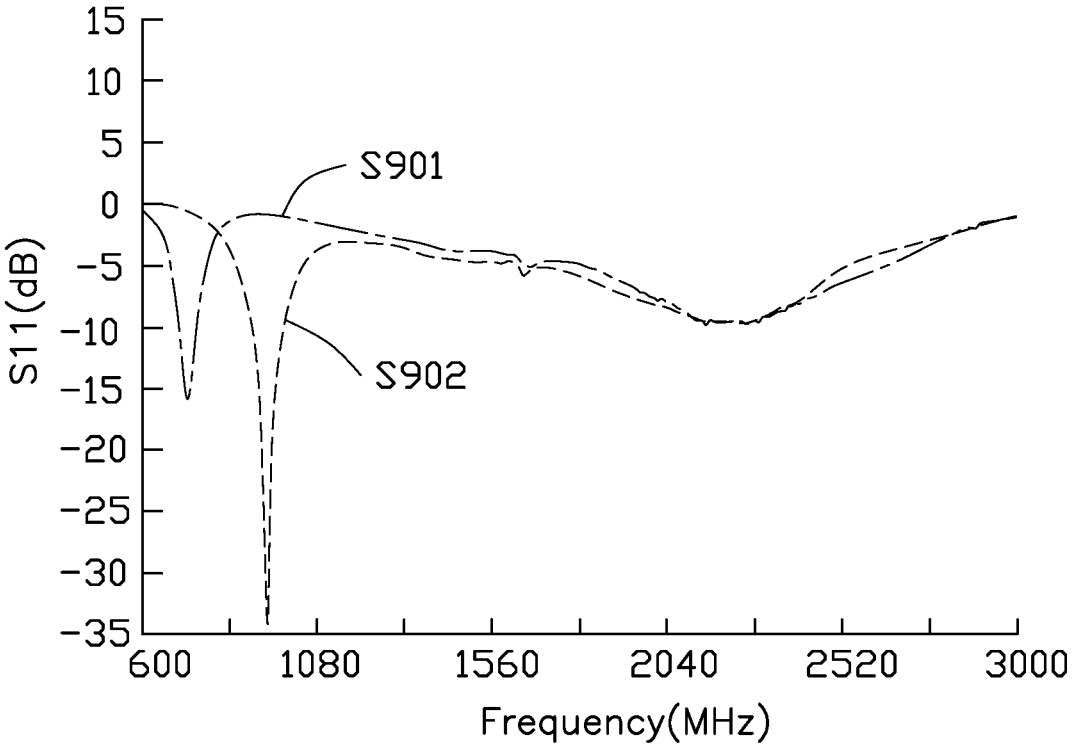
FIG. 7 is a scattering parameter graph of a portion of the antenna structure of FIG. 2 (first antenna) when the first antenna is operating at an LTE-A low frequency operating mode, an LTE-A middle frequency operating mode, and an LTE-A high frequency operating mode.

FIG. 7 illustrates a scattering parameter graph of the first antenna A1 when the first antenna A1 is operating at the LTE-A low frequency operating mode, the LTE-A middle frequency operating mode, and the LTE-A high frequency operating mode. Curve S901 is a scattering parameter of the first antenna A1 when the first antenna A1 is operating at a frequency of 700 MHz. Curve S902 is a scattering parameter of the first antenna A1 when the first antenna A1 is operating at a frequency of 900 MHz.

Figure 8:
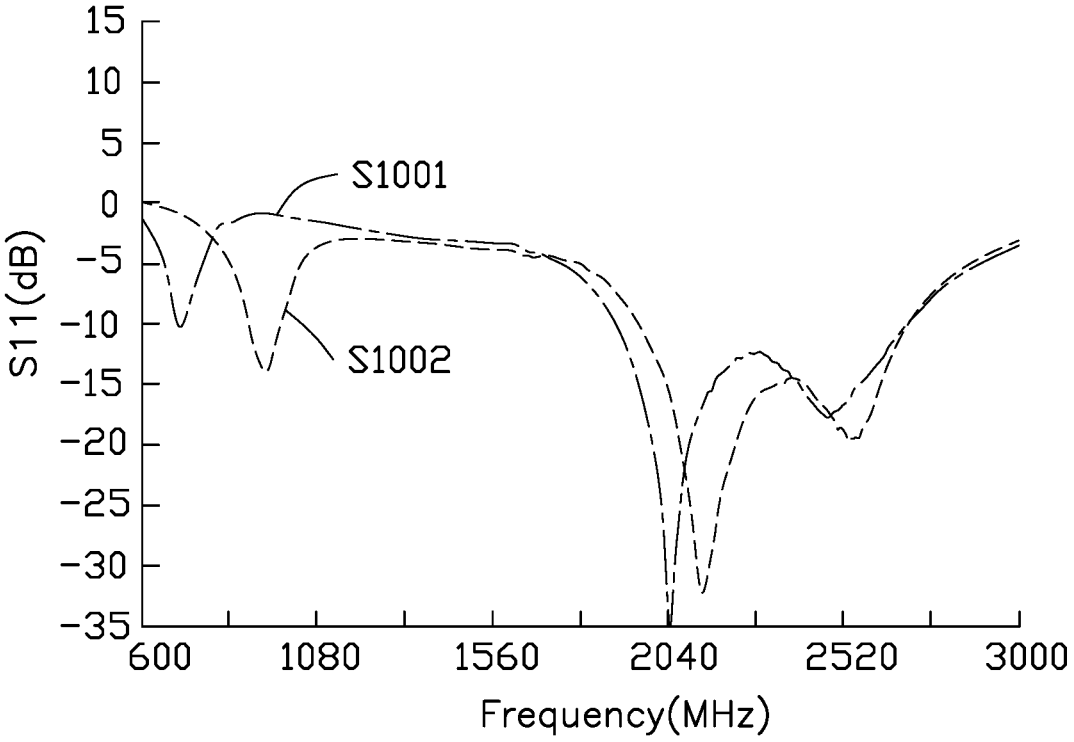
FIG. 8 is a scattering parameter graph of a portion of the antenna structure of FIG. 2 (third antenna) when the third antenna is operating at an LTE-A low frequency operating mode, an LTE-A middle frequency operating mode, and an LTE-A high frequency operating mode.

FIG. 8 illustrates a scattering parameter graph of the third antenna A3 when the third antenna A3 is operating at the LTE-A low frequency operating mode, the LTE-A middle frequency operating mode, and the LTE-A high frequency operating mode. Curve S1001 is a scattering parameter of the third antenna A3 when the third antenna A3 is operating at the frequency band of 700 MHz. Curve S1002 is a scattering parameter of the third antenna A3 when the third antenna A3 is operating at the frequency band of 900 MHz.

Figure 9:
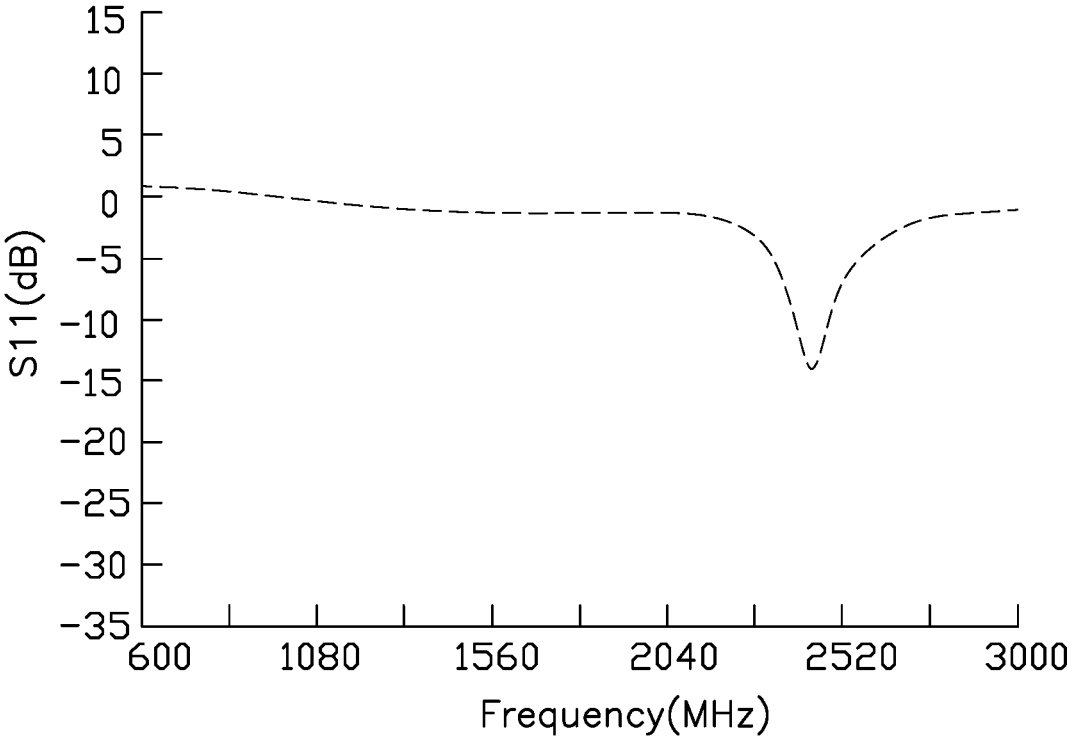
FIG. 9 is a scattering parameter graph of the antenna structure of FIG. 2 when the antenna structure is operating at WIFI 2.4 GHz operating mode and at BLUETOOTH mode.

FIG. 9 illustrates a scattering parameter graph of the antenna structure 100 when the antenna structure 100 is operating at the WIFI 2.4 GHz operating mode and in the BLUETOOTH mode.

Figure 10:
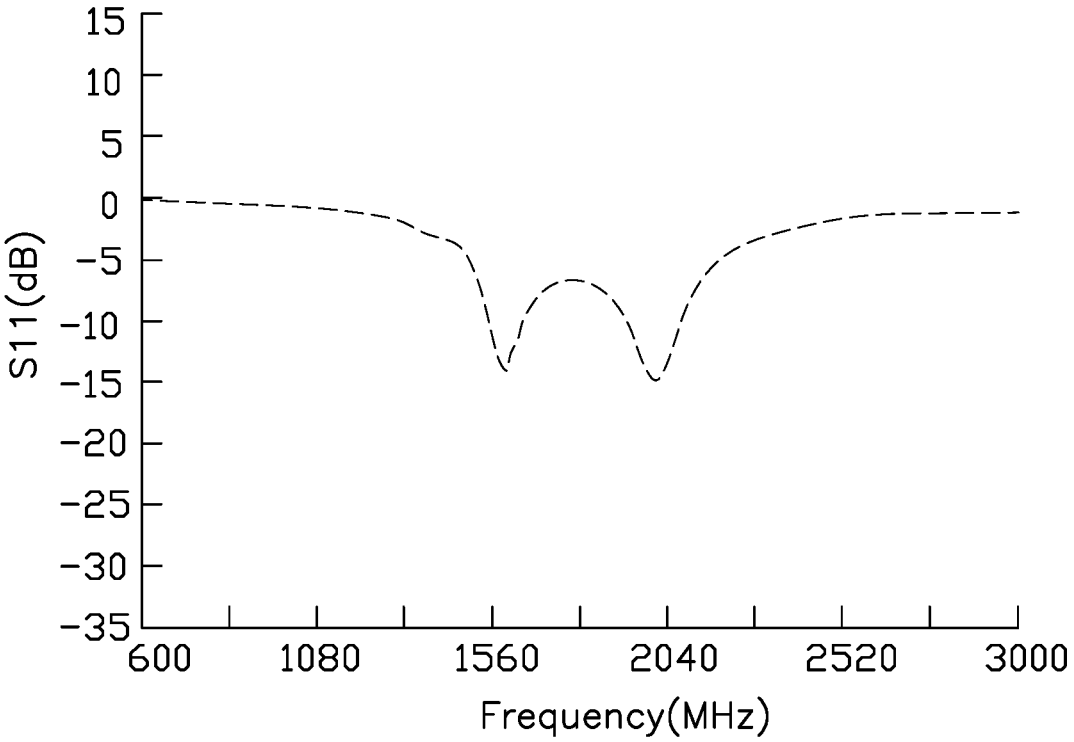
FIG. 10 is a scattering parameter graph of the antenna structure of FIG. 2 when the antenna structure is operating in GPS operating mode.

FIG. 10 illustrates a scattering parameter graph of the antenna structure 100 when the antenna structure 100 is operating in the GPS operating mode.

Figure 11:
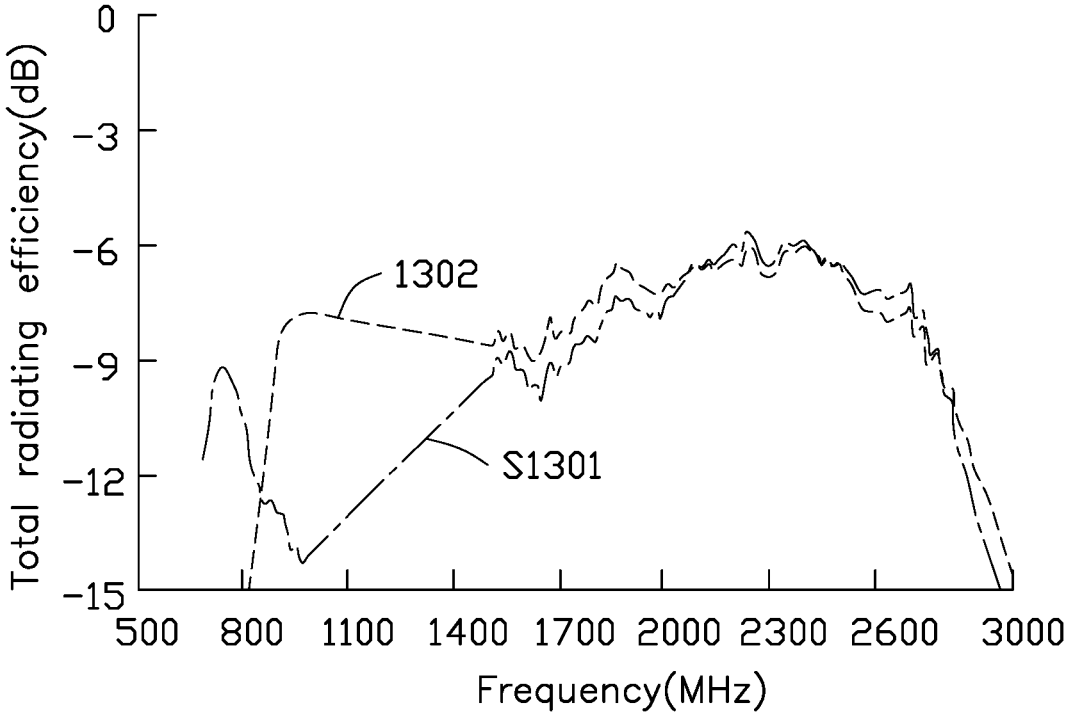
FIG. 11 is a total radiating efficiency graph of the first antenna when the first antenna is operating at an LTE-A low frequency operating mode, an LTE-A middle frequency operating mode, and an LTE-A high frequency operating mode.

FIG. 11 illustrates a total radiating efficiency graph of the first antenna A1 when the first antenna A1 is operating at the LTE-A low frequency operating mode, the LTE-A middle frequency operating mode, and the LTE-A high frequency operating mode. Curve S1301 is a total radiating efficiency of the first antenna A1 when the first antenna A1 is operating at the frequency of 700 MHz. Curve S1302 is a total radiating efficiency of the first antenna A1 when the first antenna A1 is operating at the frequency of 900 MHz.

Figure 12:
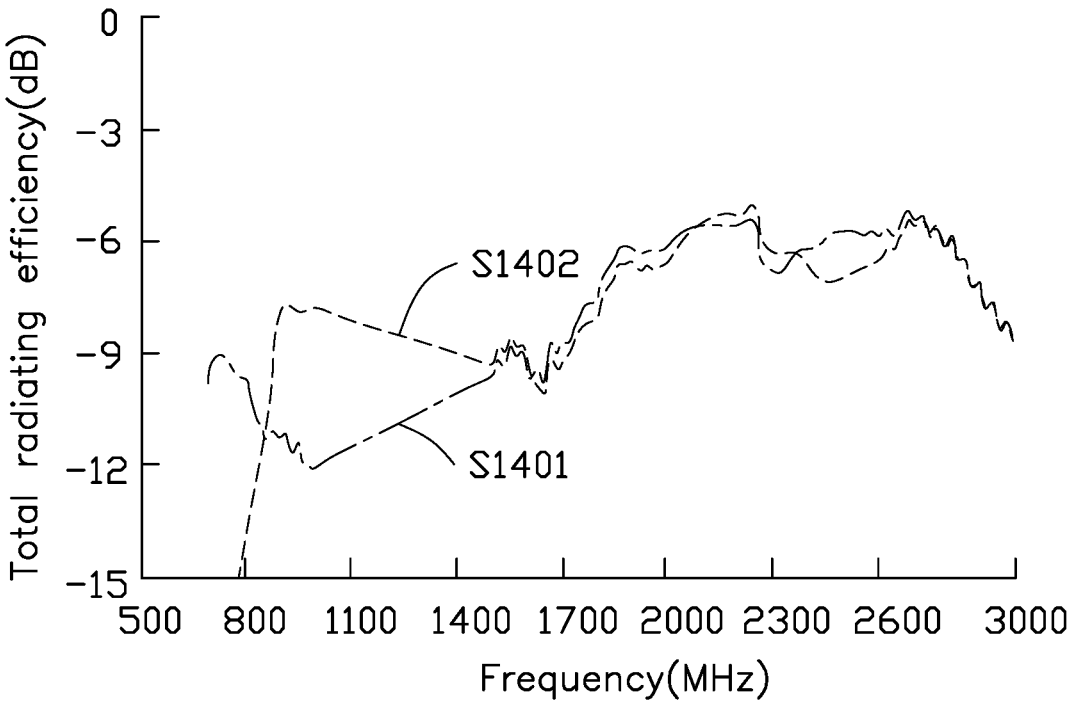
FIG. 12 is a total radiating efficiency graph of the third antenna when the third antenna is operating at an LTE-A low frequency operating mode, an LTE-A middle frequency operating mode, and an LTE-A high frequency operating mode.

FIG. 12 illustrates a total radiating efficiency graph of the third antenna A3 when the third antenna A3 is operating at the LTE-A low frequency operating mode, the LTE-A middle frequency operating mode, and the LTE-A high frequency operating mode. Curve S1401 is a scattering parameter of the third antenna A3 when the third antenna A3 is operating at the frequency of 700 MHz. Curve S1402 is a scattering parameter of the third antenna A3 when the third antenna A3 is operating at the frequency of 900 MHz.

Figure 13:
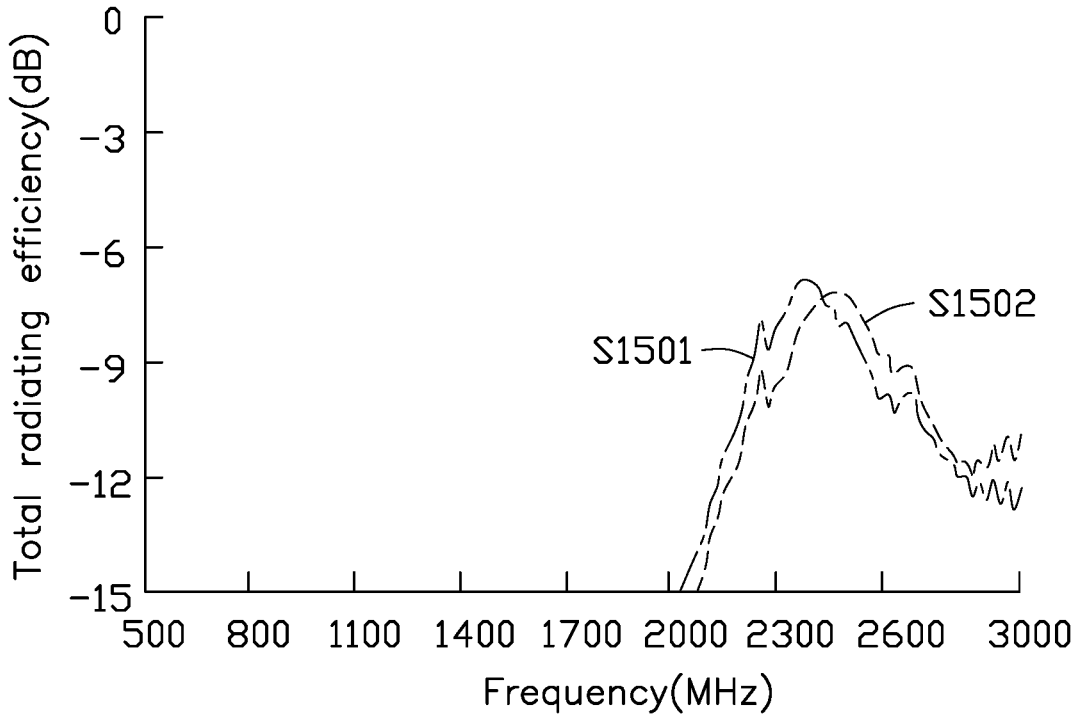
FIG. 13 is a total radiating efficiency graph of the antenna structure of FIG. 2 when the antenna structure is operating at WIFI 2.4 GHz operating mode and in BLUETOOTH mode.

FIG. 13 illustrates a total radiating efficiency graph of the antenna structure 100 when the antenna structure 100 is operating at the WIFI 2.4 GHz and BLUETOOTH operating modes. S1501 is a total radiating efficiency of the antenna structure 100 when the antenna structure 100 is operating at the WIFI 2.4 GHz and BLUETOOTH operating modes and the first antenna A1 and the third antenna A3 are both operating at the frequency of 700 MHz. S1502 is a total radiating efficiency of the antenna structure 100 when the antenna structure 100 is operating at the WIFI 2.4 GHz and BLUETOOTH operating modes and the first antenna A1 and the third antenna A3 are both operating at a frequency of 900 MHz.

Figure 14:
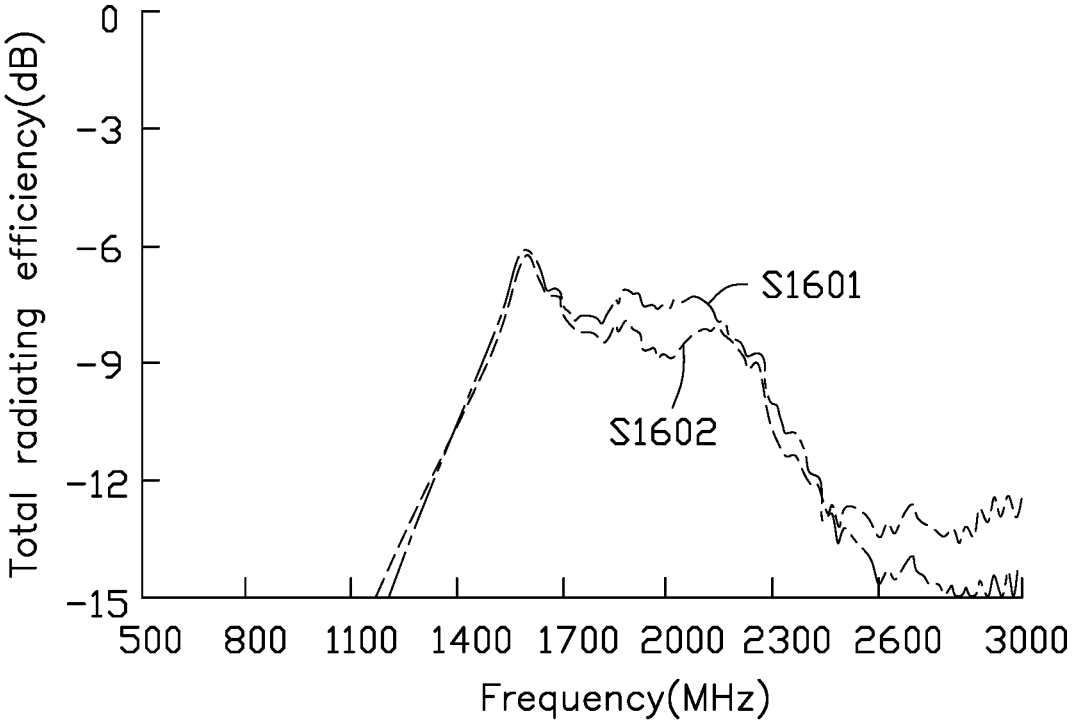
FIG. 14 is a total radiating efficiency graph of the antenna structure of FIG. 2 when the antenna structure is operating in GPS operating mode.

FIG. 14 illustrates a total radiating efficiency graph of the antenna structure 100 when the antenna structure 100 is operating at the GPS operating mode. S1601 is a total radiating efficiency of the antenna structure 100 when the antenna structure 100 is operating at the GPS operating mode and the first antenna A1 and the third antenna A3 are both operating at the frequency of 700 MHz. S1602 is a total radiating efficiency of the antenna structure 100 when the antenna structure 100 is operating at the GPS operating mode and the first antenna A1 and the third antenna A3 are both operating at the frequency of 900 MHz.

As FIG. 7 and FIG. 14 show, when the antenna structure 100 is operating at the LTE-A Band 17 (704-746 MHz), the LTE-A Band 13 (746-787 MHz), the LTE-A Band 20 (791-862 MHz), and the LTE-A Band 8 (880-960 MHz), the frequency ranges of the LTE-A middle and high frequency bands of the antenna structure 100 are about 1710-2690 MHz. Thus, the first switching circuit 17 and the second switching circuit 18 are only used to change the low frequency mode of the antenna structure 100 without affecting the high frequency mode, this characteristic is beneficial to Carrier Aggregation (CA) of LTE-A.

In this embodiment, the first feeding portion 121, the third feeding portion 123, the first radiating portion E1, the third radiating portion E3, the first branch F1, and the second branch F2 of the antenna structure 100 are mainly used to activate the LTE-A low, middle, and high frequency operating modes. In addition, by switching between the first switching circuit 17 and the second switching circuit 18, the low frequency of the antenna structure 100 can cover at least the LTE-A Band 17 (704-746 MHz), the LTE-A Band 13 (746-787 MHz), the LTE-A Band 20 (791-862 MHz), and the LTE-A Band 8 (880-960 MHz). The second feeding portion 122 and the second radiating section E2 of the antenna structure 100 are mainly used to activate the GPS operating mode. The fourth feeding portion 124 and the fourth radiating section E4 of the antenna structure 100 are mainly used to activate the WIFI 2.4 GHz and BLUETOOTH operating modes.

Furthermore, when the antenna structure 100 is operating at the LTE-A Band 17 (704-746 MHz), the LTE-A Band 13 (746-787 MHz), the LTE-A Band 20 (791-862 MHz), and the LTE-A Band 8 (880-960 MHz), then the LTE-A middle and high frequency bands, the GPS frequency band, and the WIFI and BLUETOOTH bands of the antenna structure 100 are not affected. Thus, the first switching circuit 17 and the second switching circuit 18 are only used to change the LTE-A low frequency mode of the antenna structure 100 without affecting the LTE-A middle and high frequency bands, the GPS frequency band, and the WIFI and BLUETOOTH bands.

Figure 15:
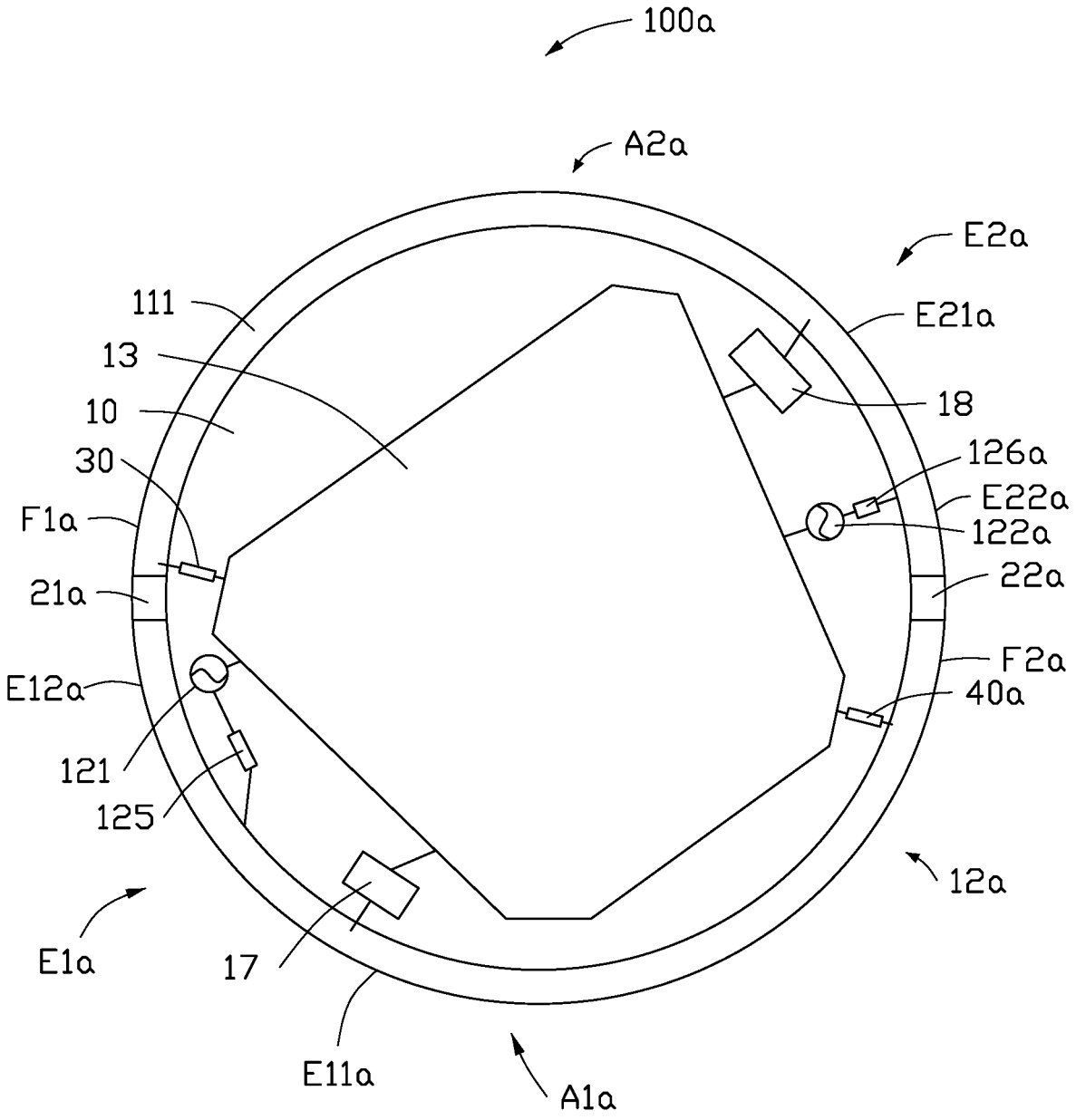
FIG. 15 is an isometric view of an antenna structure according to a second embodiment.

FIG. 15 illustrates an antenna structure 100*a* according to a second embodiment. The antenna structure 100 can be used in wireless communication device such as a mobile phone, a CPE (Customer Premise Equipment), or the like.

The antenna structure 100*a* includes a metal frame 111, at least one feeding portion 12*a*, a grounding plane 13, a first switching circuit 17, a second switching circuit 18, a first inductor 30, and a second inductor 40*a*. The at least one feeding portion 12*a* and the grounding plane 13 are positioned on the main board 10.

Differences between the antenna structure 100*a* and the antenna structure 100 include the number of gaps defined in the antenna structure 100*a*. The metal frame 111 of the antenna structure 100*a* only includes two gaps, being a first gap 21*a* and a second gap 22*a*. The first gap 21*a* and the second gap 22*a* can cooperatively divide the housing 11 into two radiating portions, which include the first radiating portion E1*a* and the second radiating portion E2*a*. A portion of the metal frame 111 between the first gap 21*a* and the second gap 22*a* at one side forms the first radiating portion E1*a*. A portion of the metal frame 111 between the first gap 21*a* and the second gap 22*a* at Other side forms the second radiating portion E2*a*.

The differences between the antenna structure 100*a* and the antenna structure 100 further include the number of feeding portions 12*a* of the antenna structure 100*a*. The at least one feeding portion 12*a* only includes the first feeding portion 121 and the second feeding portion 122*a*. One end of the first feeding portion 121 is electrically coupled to a side of the first radiating portion E1*a* adjacent to the first gap 21*a* through a first matching circuit 125. The first feeding portion 12*a* feeds current to the first radiating portion. E1*a*. The other end of the first feeding portion 121 is electrically coupled to the grounding plane 13 to be grounded. One end of the second feeding portion 122*a* is electrically coupled to a side of the second radiating portion E2*a* adjacent to the second gap 22*a* through a second matching circuit 126*a*. The second feeding portion 122*a* feeds current to the second radiating portion E2*a*. The other end of the second feeding portion 122*a* is electrically coupled to the grounding plane 13 to be grounded.

In this embodiment, the first feeding portion 121 divides the first radiating portion E1*a* into two portions, which include a first radiating section E11*a* and a second radiating section E12*a*. A portion of the metal frame 111 between the first feeding portion 121 and the second gap 22*a* forms the first radiating section Ella. A portion of the metal frame 111 between the first feeding portion 121 and the first gap 21*a* forms the second radiating section E12*a*. In this embodiment, a position of the first feeding portion 121 does not correspond to a middle portion of the first radiating portion E1*a*. Thus, a length of the first radiating portion E11*a* is longer than a length of the second radiating portion E12*a*.

In this embodiment, the second feeding portion 122*a* divides the second radiating portion E2*a* into two portions, which include a third radiating section E21*a* and a fourth radiating section E22*a*. A portion of the metal frame 111 between the second feeding portion 122*a* and the first gap 21*a* forms the third radiating portion E21*a*. A portion of the metal frame 111 between the second feeding portion 122*a* and the second gap 22*a* forms the fourth radiating portion E22*a*. In this embodiment, a position of the second feeding portion 122*a* does not correspond to a middle portion of the second radiating portion E2*a*. Thus, a length of the third radiating portion E21*a* is longer than a length of the fourth radiating portion E22*a*.

The differences between the antenna structure 100*a* and the antenna structure 100 further include the position of the second inductor 40*a*. One end of the second inductor 40*a* is connected to the second branch F2*a*, the other end of the second inductor 40*a* is connected to the grounding plane 13.

Figure 16:
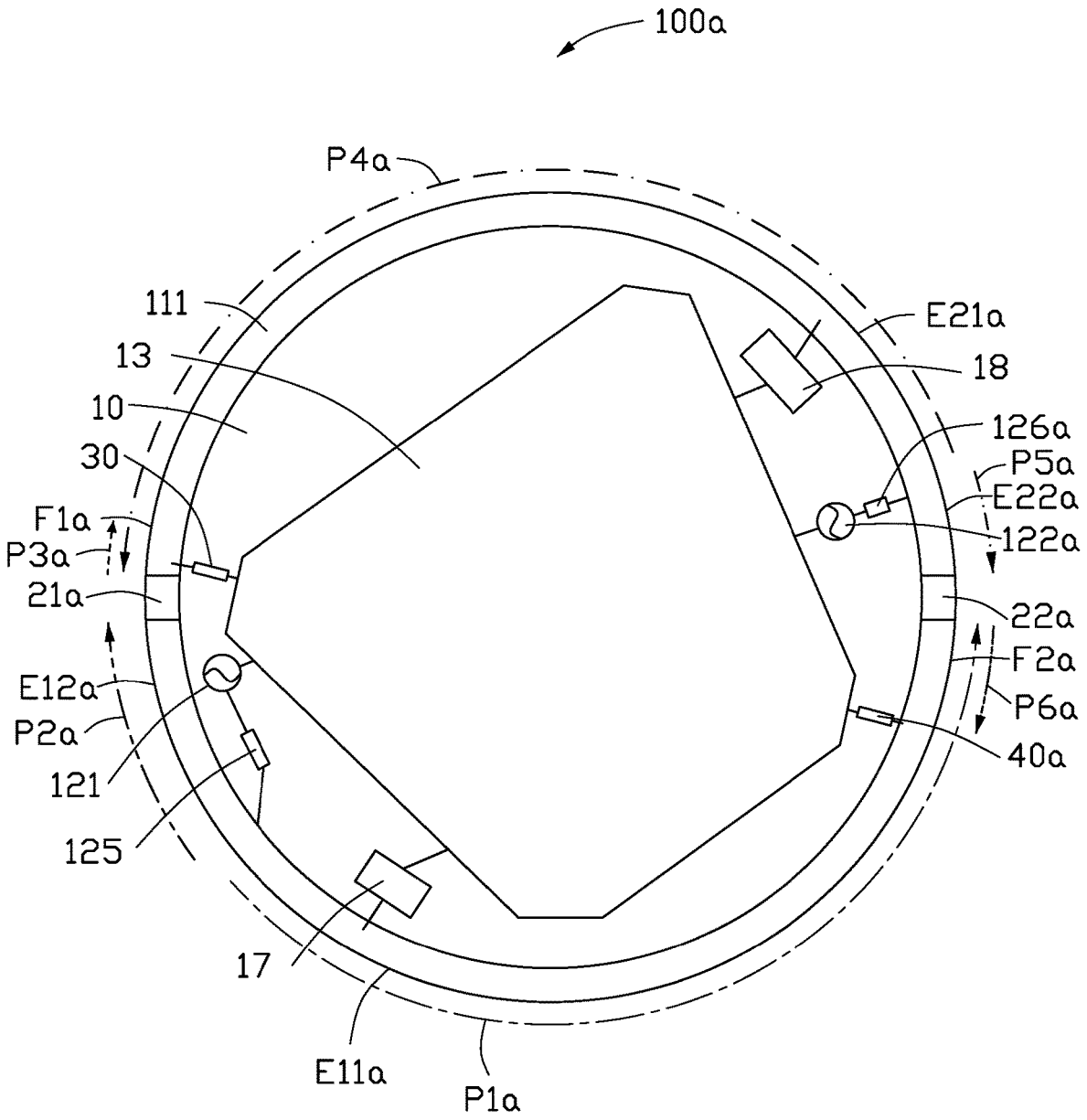
FIG. 16 is a current path distribution graph of the antenna structure of FIG. 15.

The differences between the antenna structure 100*a* and the antenna structure 100 further include different current paths of the antenna structure 100*a*. Specifically, referring to FIG. 16, when the first feeding portion 121 supplies current, the current orderly flows through the first matching circuit 125 and the first radiation section Ella, and flows to one end of the first radiating section E11*a* adjacent to the second gap 22*a*, thereby activating a first operating mode to generate radiation signals in a first frequency band (path P1*a*). When the first feeding portion 121 supplies current, the current also orderly flows through the first matching circuit 125 and the second radiation section E12*a*, and flows to one end of the second radiation section E12*a* adjacent to the first gap 21*a*, thereby activating a second operating mode to generate radiation signals in the second frequency band (path P2*a*). In addition, when the first feeding portion 121 supplies current, the current also orderly flows through the first matching circuit 125 and the second radiating section E12*a*, and is coupled to the first branch F1*a*, thereby activating a third operating mode to generate radiation signals in a third frequency band (path P3*a*).

When the second feeding portion 122*a* supplies current, the current orderly flows through the second matching circuit 126*a* and the third radiation section E21*a*, and flows to one end of the third radiation section E21*a* adjacent to a first gap 21*a*, thereby activating the first operating mode to generate the radiation signals in the first frequency band (path P4*a*). When the second feeding portion 122*a* supplies current, the current also orderly flows through the second matching circuit 126*a* and the fourth radiation section E22*a*, and flows to one end of the fourth radiation section E22*a* adjacent to the second gap 22*a*, thereby activating the second operating mode to generate the radiation signals in the second frequency band (path P5*a*). In addition, when the second feeding portion 122*a* supplies current, the current also orderly flows through the second matching circuit 126*a* and the fourth radiation section E22*a*, and couples to the second branch F2*a*, thereby activating the third operating mode to generate the radiation signals in the third frequency band (path P6*a*).

Thus, the first feeding portion 121, the first radiating section Ella, the second radiating section E12*a*, and the first branch F1*a* cooperatively form a first antenna A1*a*. The second feeding portion 122*a*, the third radiating portion E21*a*, the fourth radiating portion E22*a*, and the second branch F2*a* cooperatively form a second antenna A2*a*. The first antenna A1*a* is a main antenna. The second antenna A2*a* is a diversity antenna, which is also a secondary antenna.

Figure 17:
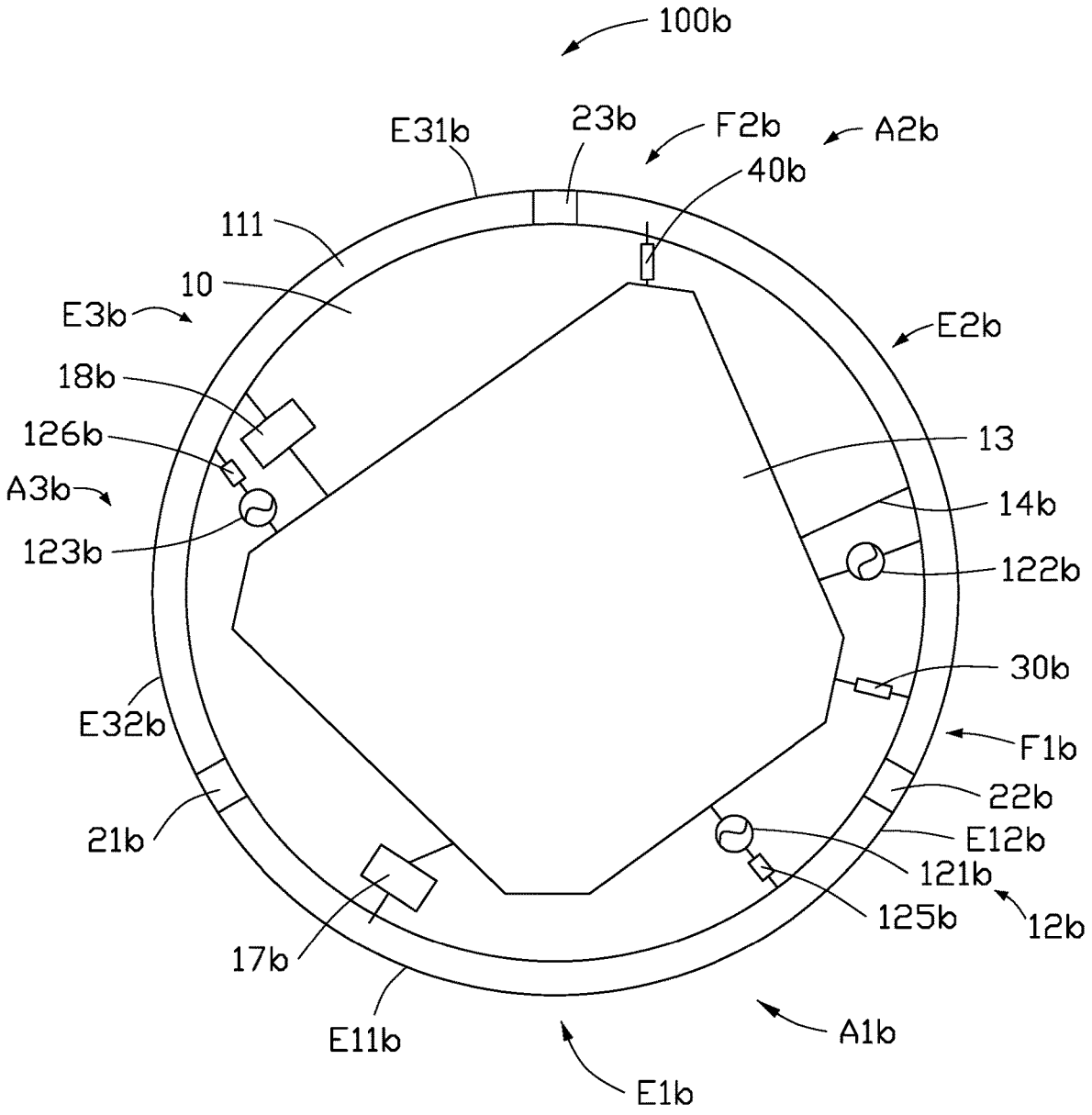
FIG. 17 is an isometric view of an antenna structure according to a third embodiment.

FIG. 17 illustrates an antenna structure according to a third embodiment (antenna structure 100*b*). The antenna structure 100*b* can be used in wireless communication device such as a mobile phone, a CPE (Customer Premise Equipment), or the like.

The antenna structure 100*b* includes a metal frame 111, at least one feeding portion 12*b*, a grounding plane 13, a first grounding portion 14*b*, a first switching circuit 17*b*, a second switching circuit 18*b*, a first inductor 30*b*, and a second inductor 40*b*. The at least one feeding portion 12*b* is configured for feeding current for the antenna structure 100. The at least one feeding portion 12*b* and the grounding plane 13 are positioned on the main board 10.

Differences between the antenna structure 100*b* and the antenna structure 100 include a different number of gaps. The antenna structure 100*b* includes three gaps, which include a first gap 21*b*, a second gap 22*b*, and a third gap 23*b*. The first gap 21*b*, the second gap 22*b*, and the second gap 23*b* cooperatively divide the housing 11 into three radiating portions, which include a first radiating portion E1*b*, a second radiating portion E2*b*, and a third radiating portion E3*b*. A portion of the metal frame 111 between the first gap 21*b* and the second gap 22*b* forms the first radiating portion E1*b*. A portion of the metal frame 111 between the second gap 22*b* and the third gap 23*b* forms the second radiating portion E2*b*. A portion of the metal frame 111 between the first gap 21*b* and the third gap 23*b* forms the third radiating portion E3*b*.

Since the number of the gaps (three) of the antenna structure 100*b* is different from the antenna structure 100, positions of the branches between the gaps are also different. In this embodiment, a portion of the metal frame 111 between the second gap 22*b* and the third gap 23*b* adjacent to the second gap 21*b* forms a first branch F1*b*. A portion of the metal frame 111 between the second gap 22*b* and the third gap 23*b* is adjacent to the third gap 23*b* forms a second branch F2*b*. The first branch F1*b* and the second branch F2*b* are positioned at different sides of the second radiating portion E1*b* to increase an isolation of the third operating mode and the third frequency band of the antenna structure 100*b*.

The differences between the antenna structure 100*b* and the antenna structure 100 further include a different number of feeding portions. In the structure 100*b*, the at least one feeding portion 12*b* includes a first feeding portion 121*b*, a second feeding portion 122*b*, and a third feeding portion 123*b*.

One end of the first feeding portion 121*b* is electrically coupled to a side of the first radiating portion E1*b* adjacent to the first gap 21*b* through a first matching circuit 125. The first feeding portion 121*b* is configured for feeding current to the first radiating portion E1*b*. The other end of the first feeding portion 121 is electrically coupled to the grounding plane 13 to be grounded.

One end of the second feeding portion 122*b* is electrically coupled to the second radiating portion E2*b* for feeding current to the second radiating portion E2*b*. The other end of the second feeding portion 122*b* is electrically coupled to the grounding plane 13 to be grounded.

One end of the third feeding portion 123*b* is electrically coupled to a side of the third radiating portion E3*b* adjacent to the first gap 21*b* through a second matching circuit 126*b* for feeding current to the third radiating portion E3*b*. The other end of the third feeding portion 123*b* is electrically coupled to the grounding plane 13 to be grounded.

In this embodiment, the first feeding portion 121*b* divides the first radiating portion E1*b* into two portions, which include a first radiating section E11*b* and a second radiating section E12*b*. A portion of the metal frame 111 between the first feeding portion 121*b* and the first gap 21*b* forms the first radiating portion E11*b*. A portion of the metal frame 111 between the first feeding portion 121*b* and the second breaking point 22*b* forms the second radiating portion E12*b*. In this embodiment, a position of the first feeding portion 121*b* does not correspond to a middle portion of the first radiating portion E1*b*. Thus, a length of the first radiating portion E11*b* is longer than a length of the second radiating portion E12*b*.

In this embodiment, the third feeding portion 123*b* divides the third radiating portion E3*b* into two portions, which include a third radiating section E31*b* and a fourth radiating section E32*b*. The metal frame 111 between the third feeding portion 123*b* and the third gap 23*b* forms the third radiating portion E31*b*. The metal frame 111 between the third feeding portion 123*b* and the first gap 21*b* forms the fourth radiating portion E32*b*. In this embodiment, a position of the third feeding portion 123*b* does not correspond to a middle portion of the third radiating portion E3*b*, a length of the third radiating portion E31*b* is longer than that of the fourth radiating portion E32*b*.

The differences between the antenna structure 100*b* and the antenna structure 100 include positions of components. The positions of the first ground portion 14*b*, the first inductor 30*b*, and the second inductor 40*b* of the antenna structure 100*b* are different from the positions of the first inductor 30, the second inductor 40, the first switching circuit 17, and the second switching circuit 18 of the antenna structure 100. One end of the first grounding portion 14*b* is electrically coupled to the second radiating portion E2*b*. The other end of the first grounding portion 14*b* is connected to the grounding plane 13 for providing grounding for the second radiating portion E2*b*. One end of the first inductor 30*b* is connected to the first branch Fla. The other end of the first inductor 30*b* is connected to the grounding plane 13 to be grounded. One end of the second inductor 40*b* is connected to the second branch F2*b*. The other end of the second inductor 40*b* is connected to the grounding plane 13 to be grounded. One end of the first switching circuit 17*b* is connected to the first radiating section E11*b*. The other end of the first switching circuit 17*b* is connected to the system ground plane 13 to grounded. One end of the second switching circuit 18*b* is connected to the third radiating section E31*b*. The other end of the second switching circuit 18*b* is connected to the grounding plane 13 to be grounded.

Figure 18:
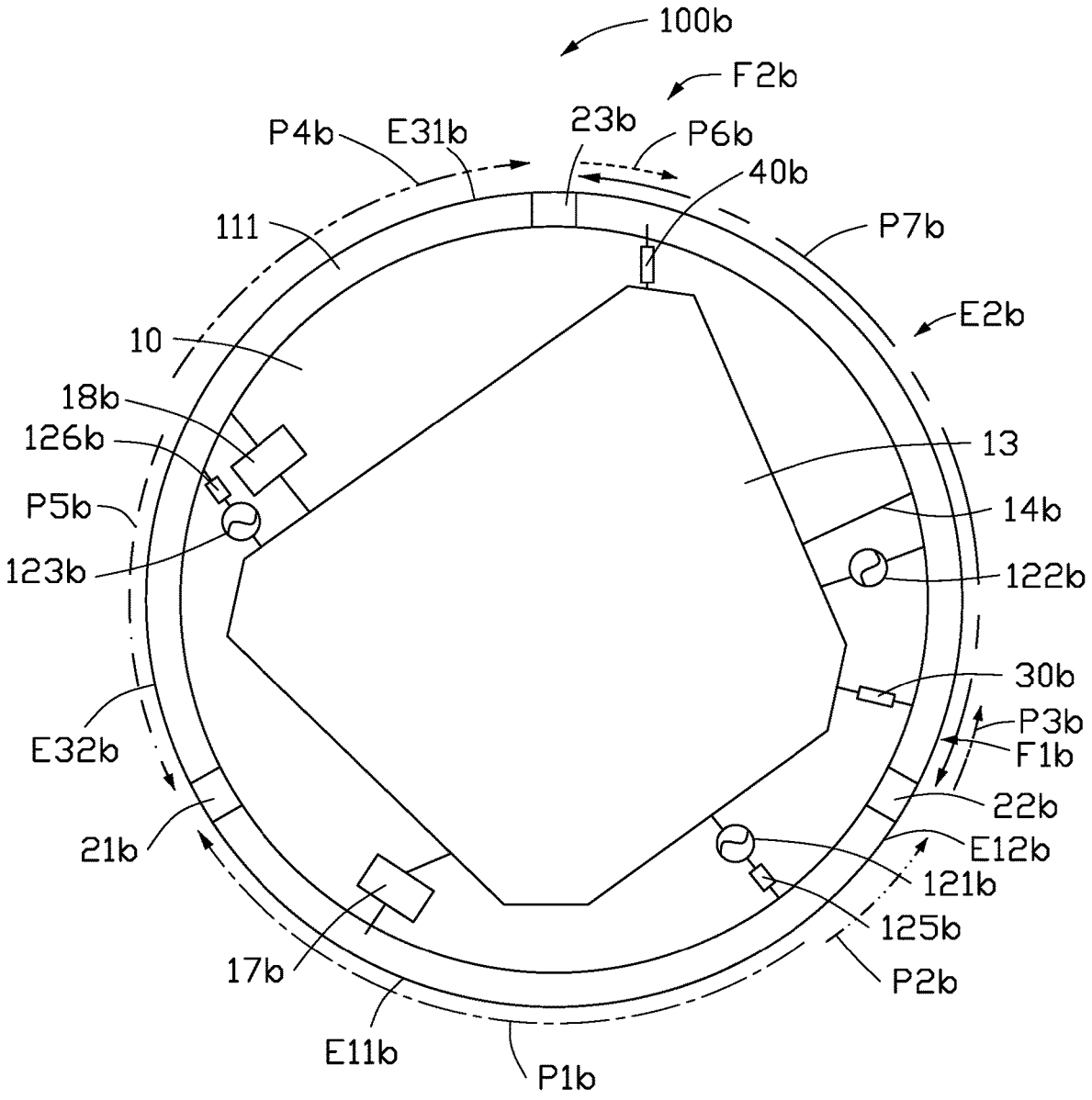
FIG. 18 is a current path distribution graph of the antenna structure of FIG. 17.

The differences between the antenna structure 100*b* and the antenna structure 100 further include different current paths. Referring to FIG. 18, when the first feeding portion 121*b* supplies current, the current orderly flows through the first matching circuit 125*b* and the first radiant section E11*b*, and flows to one end of the first radiating section E11*b* adjacent to the first gap 21*b*, thereby activating a first mode to generate radiation signals in a first frequency band (path P1*b*). When the first feeding portion 121*b* supplies current, the current also orderly flows through the first matching circuit 125*b* and the second radiation section E12*b*, and flows to one end of the second radiation section E12*b* adjacent to the second break point 22*b*, thereby activating a second mode to generate radiation signals in a second frequency band (path P2*b*). In addition, when the first feeding portion 121*b* supplies current, the current also orderly flows through the first matching circuit 125*b* and the second radiation section E12*b*, and is coupled to the first branch F1*b*, thereby activating a third mode to generate radiated signals in a third frequency band (path P3*b*).

When the third feeding portion 123*b* supplies current, the current orderly flows through the second matching circuit 126*b* and the third radiation section E31*b*, and flows to one end of the third radiation section E31*b* adjacent to the third gap 23*b*, thereby activating a first mode to generate radiation signals of the first frequency band (path P4*b*). When the third feeding portion 123*b* supplies current, the current also orderly flows through the second matching circuit 126*b* and the fourth radiation section E32*b*, and flows to one end of the fourth radiation section E32*b* adjacent to the first gap 21*b*, thereby activating the second mode to generate radiation signals in the second frequency band (path P5*b*). In addition, when the third feeding portion 123*b* supplies current, the current also orderly flows through the second matching circuit 126*b* and the third radiation section E31*b*, and is coupled to the second branch F2*b* thereby activating a third mode to generate radiation signals in the third frequency band (path P6*b*).

When the second feeding portion 122*b* supplies current, the current flows through the second radiating portion E2*b*, thereby activating a fourth mode to generate radiation signals of the fourth frequency band (path P7*b*).

In this embodiment, the first feeding portion 121*b*, the first radiating section E11*b*, the second radiating section E12*b* and the first branch F1*b* cooperatively form a first antenna A1*b*. The second feeding portion 122*b* and the second radiation portion E2*b* cooperatively form a second antenna A2*b*. The third feeding portion 123*b*, the third radiating section E31*b*, the fourth radiating section E32*b*, and the second branch F2B cooperatively form a third antenna A3*b*.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a metal frame, the metal frame defining at least two gaps, wherein the at least two gaps pass through the metal frame and extend to divide the metal frame into at least two radiating portions; and at least one feeding portion, wherein the at least one feeding portion is electrically coupled to one of the at least two radiating portions for feeding current to the corresponding radiating portion, the one of the at least two radiating portions simultaneously activates a first operating mode to generate radiation signals in a first frequency band, a second operating mode to generate radiation signals in a second frequency band, and a third operating mode to generate radiation signals in a third frequency band;

when the at least one feeding portion supplies current, the current of the first operating mode flows through the at least one feeding portion, and flows to one end of the one of the at least two radiating portions, the current of the second operating mode flows through the at least one feeding portion, and flows to the other end of the one of the at least two radiating portions, the current of the third operating mode flows through the at least one feeding portion, and flows to an end of the other one of the at least two radiation portions;

wherein the at least two gaps comprise a first gap and a second gap, the at least one feeding portion comprises a first feeding portion, a portion of the metal frame between the first feeding portion and the second gap forms a first radiating section, a portion of the metal frame between the first feeding portion and the first gap forms a second radiating section.

2. The antenna structure of claim 1, wherein the at least two gaps comprise further comprise a third gap, and a fourth gap, each of the first gap, the second gap, the third gap, and the fourth gap passes through and extends to divide the metal frame into a first radiating portion, a second radiating portion, and a third radiating portion, a portion of the metal frame between the first gap and the second gap forms the first radiating portion, a portion of the metal frame between the second gap and the third gap forms the second radiating portion, a portion of the metal frame between the third gap and the fourth gap forms the third radiating portion, the antenna structure further comprises a built-in fourth radiating portion, a portion of the metal frame between the first gap and the fourth gap adjacent to the first gap forms a first branch, a portion of the metal frame between the first gap and the fourth gap adjacent to the fourth gap forms a second branch.

3. The antenna structure of claim 2, wherein the at least one feeding portion further comprises a second feeding portion, a third feeding portion, and a fourth feeding portion, a portion of the metal frame between the third feeding portion and the fourth gap forms a third radiating section, a portion of the metal frame between the third feeding portion and the third gap forms a fourth radiating section, when the first feeding portion supplies current, the current orderly flows through the first radiating section and the second radiating section, thereby respectively activating the first operating mode and the second operating mode, when the first feeding portion supplies the current, the current flows through the second radiating section, and is coupled to the first branch, thereby activating the third operating mode, when the second feeding portion supplies the current, the current flows through the second radiating portion, thereby activating a fourth operating mode to generate radiation signals in a fourth frequency band, when the third feeding portion supplies the current, the current flows through the third radiating section and the fourth radiating section, thereby activating the first operating mode and the second operating mode, when the third feeding portion supplies the current, the current flows through the third radiating section, and is coupled to the second branch, thereby activating the third operating mode, when the fourth feeding portion supplies the current, the current flows through the fourth radiating portion, thereby activating a fifth operating mode to generate radiation signals in a fifth frequency band.

4. The antenna structure of claim 3, wherein a frequency of the first radiation frequency band is lower than a frequency of the fourth radiation frequency band, the frequency of the fourth radiation frequency band is lower than a frequency of the second radiation frequency band, the frequency of the second radiation frequency band is lower than a frequency of the third radiation frequency band and a frequency of the fifth frequency band.

5. The antenna structure of claim 3, further comprising a grounding plane, a first grounding portion, and a seconding ground portion, wherein the grounding plane comprises a metal material for providing grounding for the antenna structure, and one end of the first grounding portion is grounded through the grounding plane, the other end of the first grounding portion is electrically coupled to one end of the second radiating portion adjacent to the third gap for providing grounding for the second radiating portion, one end of the second grounding portion is grounded through the grounding plane, and the other end of the second radiating portion is electrically coupled to the fourth radiating portion for providing grounding for the fourth radiating portion.

6. The antenna structure of claim 5, further comprising a first switching circuit, wherein the first switching circuit comprises a first switching unit and a plurality of first switching elements, the first switching unit is electrically coupled to the first radiating section, the first switching elements are connected in parallel with each other, one end of each first switching element is electrically coupled to the first switching unit, the other end of each first switching element is connected to the grounding plane to be grounded, each first switching element has a different impedance, a first frequency band of the first radiating section is adjustable by controlling the first switching unit.

7. The antenna structure of claim 5, further comprising a second switching circuit, wherein the second switching circuit comprises a second switching unit and a plurality of second switching elements, the second switching unit is electrically coupled to the third radiating section, the second switching elements are connected in parallel with each other, one end of each second switching element is electrically coupled to the second switching unit, the other end of each second switching element is connected to the grounding plane, each second switching element has a different impedance, the first frequency band of the third radiating section is adjustable by controlling the second switching unit.

8. The antenna structure of claim 5, further comprising a first inductor and a second inductor, wherein one end of the first inductor is connected to the first branch, the other end of the first inductor is connected to the grounding plane, one end of the second inductor is connected to the second branch, the other end of the second inductor is connected to the grounding plane, the third frequency band is adjustable by adjusting inductance values of the first inductor and the second inductor.

9. The antenna structure of claim 2, wherein a width of each the first gap, the second gap, the third gap, and the fourth gap is less than or equal to twice the thickness of the metal frame.

10. The antenna structure of claim 5, wherein the first feeding portion, the second feeding portion, and the third feeding portion are disposed in a keep-out-zone formed between the metal frame and the grounding plane, the fourth feeding portion is disposed above the grounding plane.

11. A wireless communication device comprising:

an antenna structure comprising:

a metal frame, the metal frame defining at least two gaps, wherein the at least two gaps pass through the metal frame and extend to divide the metal frame into at least two radiating portions; and at least one feeding portion, wherein the at least one feeding portion is electrically coupled to one of the at least two radiating portions for feeding current to the corresponding radiating portion, the one of the at least two radiating portions simultaneously activates a first operating mode to generate radiation signals in a first frequency band, a second operating mode to generate radiation signals in a second frequency band, and a third operating mode to generate radiation signals in a third frequency band; when the at least one feeding portion supplies current, the current of the first operating mode flows through the at least one feeding portion, and flows to one end of the one of the at least two radiating portions, the current of the second operating mode flows through the at least one feeding portion, and flows to the other end of the one of the at least two radiating portions, the current of the third operating mode flows through the at least one feeding portion, and flows to an end of the other one of the at least two radiation portions;

wherein the at least two gaps comprise a first gap and a second gap, the at least one feeding portion comprises a first feeding portion, a portion of the metal frame between the first feeding portion and the second gap forms a first radiating section, a portion of the metal frame between the first feeding portion and the first gap forms a second radiating section.

12. The wireless communication device of claim 11, wherein the at least two gaps comprise further comprise a third gap, and a fourth gap, each of the first gap, the second gap, the third gap, and the fourth gap passes through and extends to divide the metal frame into a first radiating portion, a second radiating portion, and a third radiating portion, a portion of the metal frame between the first gap and the second gap forms the first radiating portion, a portion of the metal frame between the second gap and the third gap forms the second radiating portion, a portion of the metal frame between the third gap and the fourth gap forms the third radiating portion, the antenna structure further comprises a built-in fourth radiating portion, a portion of the metal frame between the first gap and the fourth gap adjacent to the first gap forms a first branch, a portion of the metal frame between the first gap and the fourth gap adjacent to the fourth gap forms a second branch.

13. The wireless communication device of claim 12, wherein the at least one feeding portion further comprises a third feeding portion, and a fourth feeding portion, a portion of the metal frame between the third feeding portion and the fourth gap forms a third radiating section, a portion of the metal frame between the third feeding portion and the third gap forms a fourth radiating section, when the first feeding portion supplies current, the current orderly flows through the first radiating section and the second radiating section, thereby respectively activating the first operating mode and the second operating mode, when the first feeding portion supplies the current, the current flows through the second radiating section, and is coupled to the first branch, thereby activating the third operating mode, when the second feeding portion supplies the current, the current flows through the second radiating portion, thereby activating a fourth operating mode to generate radiation signals in a fourth frequency band, when the third feeding portion supplies the current, the current flows through the third radiating section and the fourth radiating section, thereby activating the first operating mode and the second operating mode, when the third feeding portion supplies the current, the current flows through the third radiating section, and is coupled to the second branch, thereby activating the third operating mode, when the fourth feeding portion supplies the current, the current flows through the fourth radiating portion, thereby activating a fifth operating mode to generate radiation signals in a fifth frequency band.

14. The wireless communication device of claim 13, wherein a frequency of the first radiation frequency band is lower than a frequency of the fourth radiation frequency band, the frequency of the fourth radiation frequency band is lower than a frequency of the second radiation frequency band, the frequency of the second radiation frequency band is lower than a frequency of the third radiation frequency band and a frequency of the fifth frequency band.

15. The wireless communication device of claim 13, wherein the antenna structure further comprises a grounding plane, a first grounding portion, and a seconding ground portion, the grounding plane comprises a metal material for providing grounding for the antenna structure, and one end of the first grounding portion is grounded through the grounding plane, the other end of the first grounding portion is electrically coupled to one end of the second radiating portion adjacent to the third gap for providing grounding for the second radiating portion, one end of the second grounding portion is grounded through the grounding plane, and the other end of the second radiating portion is electrically coupled to the fourth radiating portion for providing grounding for the fourth radiating portion.

16. The wireless communication device of claim 15, wherein the antenna structure further comprises a first switching circuit, the first switching circuit comprises a first switching unit and a plurality of first switching elements, the first switching unit is electrically coupled to the first radiating section, the first switching elements are connected in parallel with each other, one end of each first switching element is electrically coupled to the first switching unit, the other end of each first switching element is connected to the grounding plane to be grounded, each first switching element has a different impedance, a first frequency band of the first radiating section is adjustable by controlling the first switching unit.

17. The wireless communication device of claim 15, wherein the antenna structure further comprises a second switching circuit, the second switching circuit comprises a second switching unit and a plurality of second switching elements, the second switching unit is electrically coupled to the third radiating section, the second switching elements are connected in parallel with each other, one end of each second switching element is electrically coupled to the second switching unit, the other end of each second switching element is connected to the grounding plane, each second switching element has a different impedance, the first frequency band of the third radiating section is adjustable by controlling the second switching unit.

18. The wireless communication device of claim 15, wherein the antenna structure further comprises a first inductor and a second inductor, one end of the first inductor is connected to the first branch, the other end of the first inductor is connected to the grounding plane, one end of the second inductor is connected to the second branch, the other end of the second inductor is connected to the grounding plane, the third frequency band is adjustable by adjusting inductance values of the first inductor and the second inductor.

19. The wireless communication device of claim 12, wherein a width of each the first gap, the second gap, the third gap, and the fourth gap is less than or equal to twice the thickness of the metal frame.

20. The wireless communication device of claim 15, wherein the first feeding portion, the second feeding portion, and the third feeding portion are disposed in a keep-out-zone formed between the metal frame and the grounding plane, the fourth feeding portion is disposed above the grounding plane.

* * * * *